US007378373B2

(12) United States Patent
Gotanda et al.

(10) Patent No.: US 7,378,373 B2
(45) Date of Patent: May 27, 2008

(54) ERASABLE IMAGE FORMING MATERIAL

(75) Inventors: Takeshi Gotanda, Yokohama (JP); Satoshi Takayama, Kawasaki (JP); Kenji Sano, Tokyo (JP); Yumiko Sekiguchi, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/532,786

(22) Filed: Sep. 18, 2006

(65) Prior Publication Data

US 2007/0072771 A1 Mar. 29, 2007

(30) Foreign Application Priority Data

Sep. 28, 2005 (JP) ..... 2005-281651

(51) Int. Cl.
*B41M 5/132* (2006.01)

(52) U.S. Cl. ..... 503/209; 503/201; 503/214

(58) Field of Classification Search ..... None
See application file for complete search history.

(56) References Cited

U.S. PATENT DOCUMENTS 4,098,738 A * 7/1978 Buerkley et al. ..... 503/201
4,668,967 A * 5/1987 Yahagi et al. ..... 503/221
5,679,615 A * 10/1997 Matsumoto et al. ..... 503/217
2005/0159311 A1 7/2005 Sano et al.
2005/0221206 A1 10/2005 Takayama et al.
2006/0111237 A1 5/2006 Takayama et al.

FOREIGN PATENT DOCUMENTS

| | | |
|---|---|---|
| JP | 4-108197 | 4/1992 |
| JP | 2000-284520 | 10/2000 |
| JP | 2003-255595 | 9/2003 |
| JP | 2003-268248 | 9/2003 |

* cited by examiner

*Primary Examiner*—Bruce H. Hess
(74) *Attorney, Agent, or Firm*—Oblon, Spivak, McClelland, Maier & Neustadt, P.C.

(57) ABSTRACT

An erasable image forming material includes a color former, a developer, a binder resin and 0.5 wt % or less of a plasticizer. The erasable image forming material exhibits improved erasure performance.

10 Claims, 1 Drawing Sheet

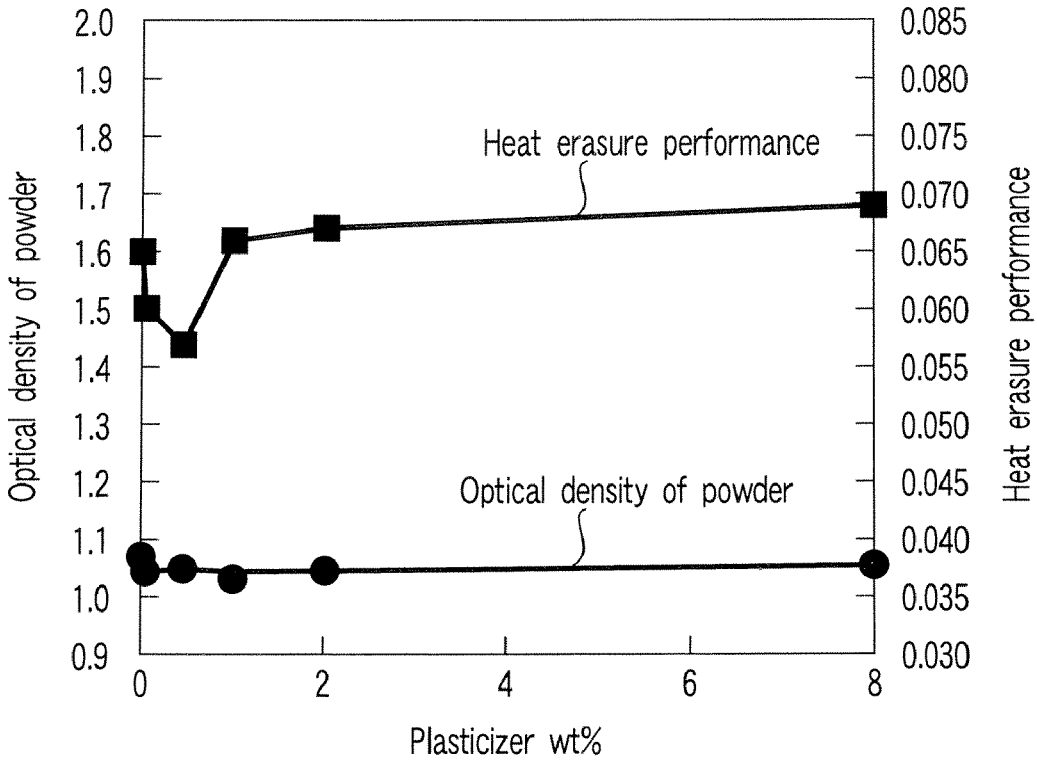
FIGURE

ERASABLE IMAGE FORMING MATERIAL

CROSS-REFERENCE TO RELATED APPLICATIONS

This application is based upon and claims the benefit of priority from prior Japanese Patent Application No. 2005-281651, filed Sep. 28, 2005, the entire contents of which are incorporated herein by reference.

BACKGROUND OF THE INVENTION

1. Field of the Invention

The invention relates to an erasable image forming material.

2. Description of the Related Art

Forest conservation is an essential requirement to maintain the terrestrial environment and suppress the greenhouse effect caused by $CO_2$. In order to minimize additional tree trimming and to keep balance with forest regeneration including tree planting, it is important how to utilize the existing paper resources efficiently.

Currently, paper resources are "recycled" by recovering paper fibers from used paper through a deinking step of removing image forming materials printed on the used paper, remaking paper fibers to manufacture recycled paper with low paper quality, and using the recycled paper according to the purpose. Thus, problems of a high cost of the deinking step and possibility of new environmental pollution by waste fluid treatment are pointed out.

On the other hand, "reuse" of a hard copy has been put into practice through erasure of images, for example, by using an eraser for pencil images and a correcting fluid for ink images. Here, the concept of "reuse" in which a paper sheet is repeatedly used for the same purpose while preventing degradation of paper quality as much as possible is different from the concept of "recycling" in which a paper sheet with degraded quality is used for other purposes. Now, the "reuse" can be said to be more important concept from a viewpoint of conservation of paper resources. Recently, a rewritable paper has been proposed, which is a special paper intended to reuse hard copy paper. Use of the rewritable paper technology enables the paper to be "reused" many times. However, the rewritable paper is a special paper which can be "reused" but cannot be "recycled". Accordingly, the rewritable paper is a defective technique from the viewpoint of protection of paper resources.

The present inventors have paid their attention to a phenomenon caused by a system of a color former and a developer that a colored state is realized when interaction between the color former and the developer is increased and an erased state is realized when the interaction is decreased. Thus, the inventors have proposed, as paper reuse techniques, image forming materials made of a composition system comprising a color former and a developer to which an erasing agent capable of capturing the developer is added. The image forming materials can exhibit stably a colored state around room temperature and can retain an erased state for a long time at practical temperatures by treatment with heat or a solvent. The inventors have also proposed image erasing processes and image erasing apparatuses using the image forming materials. These image forming materials have advantages of highly stable colored and erased states of the images, highly safety in view of materials, applicability to electrophotography toners, liquid inks, ink ribbons and writing instruments, and feasibility of large-scale erasure treatment, which cannot be realized so far. Since the image forming materials can be recycled after the reuse steps, the efficiency of use of paper resources can be remarkably improved.

The present inventors have further found through intensive studies on the improvement of the erasable image forming material that, in a case where a paper sheet is used as image recording medium, even an image forming material not containing an erasing agent can be erased by above two methods of treatment with heat or a solvent, because cellulose that is a constituting component of paper has an ability to capture the developer. Thus, the present inventors have also proposed an image forming material containing no erasing agent and an erasing method for the material. See, for example, JP-A 2000-284520 (KOKAI).

However, since the paper sheet takes the function of capturing the developer for the particular erasable image forming material, the erasure performance of the material is controlled by diffusion migration of the developer in the binder resin. Accordingly, in the above erasable image forming material, the property of the binder resin becomes one of factors to prevent the erasure performance from being improved.

BRIEF SUMMARY OF THE INVENTION

An erasable image forming material according to an aspect of the present invention comprises: a color former; a developer; a binder resin; and 0.5 wt % or less of a plasticizer.

BRIEF DESCRIPTION OF THE SEVERAL VIEWS OF THE DRAWING

The single FIGURE is a graph showing a relationship between a plasticizer content and heat erasure performance as well as optical density of powder for erasable image forming materials in Example 1.

DETAILED DESCRIPTION OF THE INVENTION

The erasable image forming material according to embodiments of the invention comprises a color former, a developer and a binder resin to which a plasticizer is added, and exhibits improved heat erasure performance. The principle of improvement in the heat erasure performance may be deduced as follows.

Polymer molecules constituting the binder resin usually maintain a rigid state hard to deform since the motion of the molecular chains is restrained by intermolecular force. However, if a plasticizer is added thereto, the plasticizer penetrates between the polymer molecular chains and prevents the molecular chains from being close to one another, thereby reducing restraint through the intermolecular force. Consequently, the developer that has interacted with the color former to develop a color can readily migrate in the binder resin to the paper sheer taking the function of capturing the developer. Since cellulose constituting the paper sheet is abundant in hydroxyl groups, hydrogen bonds are formed between phenolic hydroxyl groups of the developer and hydroxyl groups of cellulose, and the developer does not act on color former any more. Accordingly, the erasable image forming material to which the plasticizer is added exhibits improved erasure performance.

It has been found that the addition amount of the plasticizer to the image forming material that affords an improvement effect for the erasure performance is 0.5 wt % or less.

Although it has been expected that a larger addition amount of the plasticizer brings a higher effect, such effect is not obtained if the addition amount exceeds the above range, contrary to expectation. However, if the addition amount of the plasticizer is too small, a sufficient effect is not obtained because the plasticizer cannot be sufficiently dispersed over the entire binder resin. In order to obtaining a sufficient effect, the addition amount of the plasticizer should preferably be 0.05 wt % or more.

Examples of the plasticizer include phthalic acid derivatives, adipic acid derivatives, azelaic acid derivatives, sebacic acid derivatives, maleic acid derivatives, fumaric acid derivatives, trimellitic acid derivatives, citric acid derivatives, oleic acid derivatives, ricinoleic acid derivatives, sulfonic acid derivatives, phosphoric acid derivatives, glycerin derivatives, paraffin derivatives and diphenyl derivatives. Specific examples of the plasticizer include (2-ethylhexyl) phthalate, dimethyl phthalate, diethyl phthalate, dibutyl phthalate, diisobutyl phthalate, diheptyl phthalate, diisooctyl phthalate, octyl decyl phthalate, diisodecyl phthalate, ditridecyl phthalate, ethylhexyl decyl phthalate, dinonyl phthalate, butyl benzyl phthalate, dicyclohexyl phthalate, diallyl phthalate, dimthoxyethyl phthalate, dibutoxyethyl phthalate, methyl phthalylethyl glycol, ethyl phthalylethyl glycolate, butyl phthalylbutyl glycolate, di-n-butyl adipate, diisobutyl adipate, di(2-ethylhexyl)adipate, diisooctyl adipate, diisodecyl adipate, octyl decyl adipate, benzyl n-butyl adipate, polypropylene adipate, polybutylene adipate, dibutoxyethyl adipate, benzyl octyl adipate, di(2-ethylhexyl) azelate, di-2-ethylhexyl 4-thioazelate, di-n-hexyl azelate, diisobutyl azelate, dimethyl cebacate, diethyl cebacate, dibutyl cebacate, di(2-ethylhexyl) cebacate, diisooctyl cebacate, di-n-butyl malate, dimethyl malate, diethyl malate, di(2-ethylhexyl)malate, dinonyl malate, dibutyl fumarate, di(2-ethylhexyl) fumarate, tri(2-ethylhexyl) trimelitate, triisodecyl trimelitate, n-octyl n-decyl trimelitate, triisooctyl trimelitate, diisooctyl monoisodecyl trimelitate, triethyl citrate, tri-n-butyl citrate, methyl oleate, butyl oleate, methoxyethyl oleate, tetrahydrofurfuryl oleate, glyceryl monooleate, diethyleneglycol monooleate, methylacetyl ricinoleate, butylacetyl ricinoleate, glyceryl monolicinoleate, diethyleneglycol monolicinoleate, benzenesulfone butylamide, o-toluene sulfonamide, p-toluene sulfonamide, N-ethyl-p-toluene sulfonamide, o-toluene ethy lsulfonamide, p-toluene ethyl sulfonamide, N-cyclohexyl-p-toluene sulfonamide, triethyl phosphate, tributyl phosphate, tri(2-ethylhexyl) phosphate, triphenyl phosphate, tris(chloroethyl)phosphate, polyethyleneglycol, chlorinated paraffin and chlorinated diphenyl. The phthalic acid derivatives, trimellitic acid derivatives and citric acid derivatives having a benzene ring or alicyclic structure exhibit a particularly high effect.

Other components used for the image forming material according to embodiments of the invention will be described hereinafter.

Examples of the color former include electron-donating organic compounds such as leucoauramines, diaryl phthalides, polyaryl carbinols, acyl auramines, aryl auramines, rhodamine B lactams, indolines, spiropyrans and fluorans. Specific examples of the color former include crystal violet lactone (CVL), malachite green lactone, 2-anilino-6-(N-cyclohexyl-N-methylamino)-3-methylfluoran, 2-anylino-3-methyl-6-(N-methyl-N-propylamino)fluoran, 3-[4-(4-phenylaminophenyl)aminophenyl]amino-6-methyl-7-chlorofluoran, 2-anilino-6-(N-methyl-N-isobutylamino)-3-methylfluoran, 2-anilino-6-(dibutylamino)-3-methylfluoran, 3-chloro-6-(cyclohexylamino)fluoran, 2-chloro-6-(diethylamino)fluoran, 7-(N,N-dibenzylamino)-3-(N,N-diethylamino)fluoran, 3,6-bis(diethylamino)fluoran-γ-(4'-nitro) anilinolactam, 3-diethylaminobenzo[a]fluoran, 3-diethylamino-6-methyl-7-aminofluoran, 3-diethylamino-7-xylidinofluoran, 3-(4-diethylamino-2-ethoxyphenyl)-3-(1-ethyl-2-methylindol-3-yl)-4-azaphthalide, 3-(4-diethylaminophenyl)-3-(1-ethyl-2-methylindole-3-yl)phthalide, 3-diethylamino-7-chloroanilinofluoran, 3-diethylamino-7,8-benzofluoran, 3,3-bis(1-n-butyl-2-methylindle-3-yl)phthalide, 3,6-dimethylethoxyfluoran, 3-diethylamino-6-methoxy-7-aminofluoran, DEPM, ATP, ETAC, 2-(2-chloroanilino)-6-dibutylaminofluoran, crystal violet carbinol, malachite green carbinol, N-(2,3-dichlorophenyl) leucoauramine, N-benzoyl auramine, rhodamine B lactam, N-acetyl auramine, N-phenyl auramine, 2-(phenyliminoethanezyliden)-3,3-dimethylindoline, N,3,3-trimethyl-indolinobenzospiropyran, 8'-methoxy-N,3,3'-trimethylindolinobenzospiropyran, 3-diethylamino-6-methyl-7-chlorofluoran, 3-diethylamino-7-methoxyfluoran, 3-diethylamino-6-benzyloxyfluoran, 1,2-benz-6-diethylaminofluoran, 3,6-di-p-toluidino-4,5-dimethylfluoran, phenylhydrazide-γ-lactam and 3-amino-5-methylfluoran. These may be used alone or in a mixture of two or more species. Since color development states of various colors can be obtained by appropriately selecting the color former, it is possible to cope with requirement for color application.

Examples of the developer include phenols, metal phenolates, metal carboxylates, benzophenones, sulfonic acids, sulfonates, phosphoric acids, metal phosphorares, acidic phosphates, metal acidic phosphates, phosphorous acids and metal phosphites. These may be used alone or in a mixture of two or more species. Specific examples of favorable developers include gallic acid; gallates such as methyl gallate, ethyl gallate, n-propyl gallate, i-propyl gallate and butyl gallate; dihydroxybenzoic acid and esters thereof such as 2,3-dihydroxybenzoic acid and methyl 2,3-dihydroxybenzoate; hydroxylacetophenones such as 2,4-dihydroxyacetophenone, 2,5-dihydroxyacetophenone, 2,6-dihydroxyacetophenone, 3,5-dihydroxyacetophenone and 2,3,4-trihydroxyacetophenone; hydroxylbenzophenones such as 2,4-dihydroxybenzophenone, 4,4'-dihydroxybenzophenone, 2,3,4-trihydroxybenzophenone, 2,4,4'-trihydroxybenzophenone, 2,2',4,4'-tetrahydroxybenzophenone and 2,3,4,4'-tetrahydroxybenzophenone; biphenols such as 2,4'-biphenol and 4,4'-biphenol; and polyhydric phenols such as 4-[(4-hyrodxyphenyl)methyl]-1,2,3-benzenetriol, 4-[(3,5-dimethyl-4-hydroxyphenyl)methyl]-1,2,3-benzenetriol, 4,6-bis[(3,5-dimethyl-4-hydroxyphenyl)methyl]-1,2,3-benzenetriol, 4,4'-[1,4-phenylenebis(1-methylethylidene)bis(benzene-1,2,3-triol)], 4,4'-[1,4-phenylenebis(1-methylethylidene)bis(1,2-benzenediol)], 4,4',4"-ethylidenetrisphenol, 4,4'-(1-methylethylidene)bisphenol and methylenetris-p-cresol.

The binder resin will be described below. The erasable image forming material usually exhibits a higher color density as the polar group content of the binder resin decreases. In order to obtain high contrast between colored and erased states, a non-polar resin is preferably used as the binder resin. Examples of the favorable non-polar resin include polystyrene, polystyrene derivatives and styrene copolymers. Specific examples of a styrene-based monomer include styrene, o-methylstyrene, m-methylstyrene, p-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene and 3,4-dichlorostyrene. Examples of the favorable styrene copolymer include styrne-butadiene copolymer, styrene-p-chlorostyrene copolymer, styrene-propylene copolymer and styrene-chloroprene copolymer. The styrene-butadiene copolymer, styrene-propylene copolymer and styrene-chloroprene copolymer are particularly suitable for toner application. The rubber component content (such as butadiene, propylene and chloroprene) of the styrene copolymer is preferably in the range of 2 to 15 wt %, more preferably about 10 wt %.

A charge control agent used for an erasable toner is required to be colorless so as not to remain a color after erasure. Among the usually used charge control agents, favorable examples of a negative charge control agent include E-84 (a zinc salicylate compound) available from Orient Chemical Industries, Ltd., N-1, N-2 and N-3 (phenolic compounds) available from Nippon Kayaku Co, Ltd., and FCA-1001N (a styrene-sulfonate-based resin) available from Fujikura Kasei Co, Ltd., while favorable examples of a positive charge control agent include TP-302 (CAS No. 116810-46-9) and TP-415 (CAS No. 117342-25-2) available from Hodogaya Chemical Co, Ltd., P-51 (a quaternary ammonium compound) and AFP-B (a polyamine oligomer) available from Orient Chemical Industries Ltd., and FCA-201PB (a styrene-acrylic quaternary ammonium salt-based resin) available from Fujikura Kasei Co, Ltd.

A wax may be added to an erasable toner for controlling a fixing property. The wax is preferably made of a higher alcohol, higher ketone or higher fatty acid ester, and an acid value thereof is preferably 10 or less. The wax preferably has a weight-average molecular weight of $10^2$ to $10^5$, more preferably $10^2$ to $10^4$. As long as the weight-average molecular weight is within the above range, low molecular-weight polypropylene, low molecular-weight polyethylene, low molecular-weight polybutylene, and low molecular-weight polyalkane may be used as the wax. The addition amount of the wax to the erasable toner is preferably 0.1 to 30 parts by weight, more preferably 0.5 to 15 parts by weight. In a toner of a type fixed with a heat roll, the wax is added for imparting a releasing property from the heat roll, and the addition amount thereof is 5 parts by weight or less. In a toner of a type fixed with pressure, the wax constitutes a major component thereof and forms a core part of a microcapsule structure.

In an erasable toner, external additives may be added, if required, to control flowability, shelf life, anti-blocking property, and grinding property for photosensitive body. Examples of the external additives include silica fine particles, metal oxide fine particles, and cleaning auxiliary. Examples of the silica fine particles include silicon dioxide, sodium silicate, zinc silicate, and magnesium silicate. Examples of the metal oxide fine particles include zinc oxide, magnesium oxide, zirconium oxide, strontium titanate, and barium titanate. Examples of the cleaning auxiliary include resin fine powder such as polymethyl methacrylate, polyvinylidene fluoride, and polytetrafluoroethylene. These external additives may be subjected to surface treatment for hydrophobing. External additives used for a toner are usually subjected to hydrophobing treatment. In the case of negative charging, a hydrophobing agent such as a silane coupling agent, a titanium coupling agent and silicone oil may be used. In the case of positive charging, a hydrophobing agent such as an aminosilane-based hydrophobing agent and silicone oil having amine in the side chains thereof may be used. The addition amount of the external additive is preferably 0.05 to 5 parts by weight, and more preferably 0.1 to 3.0 parts by weight to 100 parts by weight of toner. Silica particles generally used have a number-average particle size for a primary particle of 10 to 20 nm. Silica particles with a particle size of about 100 nm may also be used. As to other material than silica, particles generally used have a number-average particle size for a primary particle of 0.05 to 3 μm.

EXAMPLES

Example 1

Compounded were 4.15 wt % of Blue 203 (a leuco dye available from Yamada Chemical Co, Ltd.) as a color former, 2 wt % of ethyl gallate as a developer, 5 wt % of polypropylene wax as a wax component, 1 wt % of LR147 (available from Japan Carlit Co, Ltd.) as a charge control agent, 87.85 to 79.85 wt % of styrene-butadiene copolymer (10 wt % of butadiene content) as a binder resin, and 0 to 8 wt % of di(2-ethylhexyl) phthalate as a plasticizer in total of 100 wt %. The compound was sufficiently mixed with a Henschel mixer, and was kneaded with a three-roller kneader. The kneaded product was processed into powder with an average particle size of 11.3 μm with a pulverizer to prepare a blue toner for electrophotography. Then, one part by weight of hydrophobic silica was externally added to the powder.

The prepared toner was loaded in a multi-function printer (Primage 351 of TOSHIBA TEC Corporation), and solid patterns in several levels of image density were printed on a copy paper sheet as images for evaluating the erasure performance. Heat erasure was performed at 130° C. for 2 hours in a thermostat.

The results of erasure are shown in FIGURE. In FIGURE, the horizontal axis denotes the addition amount of di(2-ethylhexyl) phthalate, and the vertical axis denotes the heat erasure performance and the optical density of powder.

The heat erasure performance was represented by a inclination of a regression equation (regression coefficient) obtained by setting the image density after heat erasure as y and the image density before erasure as x. The lower value means a readily erasable toner. The image density is represented by a common logarithm of a reciprocal of reflectance which is measured for the image printed on the paper sheet.

The optical density of powder is represented by a common logarithm of a reciprocal of reflectance which is measured for the powder with an average particle size of 11.3 μm put in a powder cell of a calorimeter (CR 300 manufactured by Minolta). The higher optical density of powder means a deep color.

As shown in FIGURE, it was found that the toner to which di(2-ethylhexyl) phthalate was added in a range of 0.5 wt % or less was readily erasable since the level of heat erasure performance was lowered. No effect of improving the heat erasure performance could be obtained when the addition amount exceeded 0.5 wt %. It should be noted that the addition amount of the plasticizer did not influence the optical density of powder.

This example shows that the heat erasure performance can be improved by adding di(2-ethylhexyl) phthalate in the range of 0.05 to 0.5 wt %.

Example 2

A toner was prepared using the same leuco dye, developer, resin, charge control agent and wax as those used in Example 1, and 0.5 wt % of diisodecyl phthalate as a plasticizer. The toner was evaluated by the same method as in Example 1. The heat erasure performance was 0.056, and the optical density of powder was 1.06. The heat erasure performance was improved even in this example.

Example 3

A toner was prepared using the same leuco dye, developer, resin, charge control agent and wax as those used in Example 1, and 0.5 wt % of dimethyl phthalate as a plasticizer. The toner was evaluated by the same method as in Example 1. The heat erasure performance was 0.057, and the optical density of powder was 1.11. The heat erasure performance was improved even in this example.

Example 4

A toner was prepared using the same leuco dye, developer, resin, charge control agent and wax as those used in Example 1, and 0.5 wt % of butyl benzyl phthalate as a plasticizer. The toner was evaluated by the same method as in Example 1. The heat erasure performance was 0.060, and the optical density of powder was 1.10. The heat erasure performance was improved even in this example.

Example 5

A toner was prepared using the same leuco dye, developer, resin, charge control agent and wax as those used in Example 1, and 0.5 wt % of isobutyl oleate as a plasticizer. The toner was evaluated by the same method as in Example 1. The heat erasure performance was 0.063, and the optical density of powder was 1.03. The heat erasure performance was improved even in this example.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An erasable image forming material comprising: a color former; a developer; a binder resin formed of a styrene-butadiene copolymer; and 0.05 to 0.5 wt % of a plasticizer selected from group consisting of di(2-ethylhexyl) phthalate, diisodecyl phthalate, dimethyl phthalate, butyl benzyl phthalate, and isobutyl oleate.

2. The material according to claim 1, wherein a butadiene content of the styrene-butadiene copolymer is in a range of 2 to 15 wt %.

3. The material according to claim 1, further comprising a wax component.

4. The material according to claim 1, further comprising a charge control agent.

5. The material according to claim 1, further comprising an external additive selected from the group consisting of a silica fine particle, a metal oxide fine particle, and a cleaning auxiliary.

6. The material according to claim 1, comprising di(2-ethylhexyl) phthalate.

7. The material according to claim 1, comprising diisodecyl phthalate.

8. The material according to claim 1, comprising dimethyl phthalate.

9. The material according to claim 1, comprising butyl benzyl phthalate.

10. The material according to claim 1, comprising isobutyl oleate.

* * * * *